US005437071A

United States Patent [19]

Feigenbaum

[11] Patent Number: 5,437,071

[45] Date of Patent: Aug. 1, 1995

[54] INDIVIDUAL PROTECTIVE PADS FOR CRIB BALUSTERS

[76] Inventor: Jeffery J. Feigenbaum, 7339 N. Karlov Ave., Chicago, Ill. 60646

[21] Appl. No.: 231,278

[22] Filed: Apr. 22, 1994

[51] Int. Cl.[6] ..... A47D 15/00

[52] U.S. Cl. ..... 5/663; 5/424; 5/93.1; 248/345.1

[58] Field of Search ..... 5/93.1, 100, 424, 663; 248/345.1

[56] References Cited

U.S. PATENT DOCUMENTS

| | | | |
|---|---|---|---|
| 959,116 | 5/1910 | Covert . | |
| 1,620,933 | 3/1927 | Wilcox | 5/93.1 X |
| 2,203,921 | 6/1940 | Padjer | 5/43.1 X |
| 2,600,556 | 6/1952 | Malm | 5/93.1 |
| 3,430,272 | 3/1969 | Thorn, Jr. | 5/93.1 |
| 3,803,646 | 4/1974 | Newerowski . | |
| 3,877,090 | 4/1975 | Schutz . | |
| 4,523,745 | 6/1985 | Killman et al. | 5/424 X |
| 4,670,923 | 6/1987 | Gabriel et al. . | |
| 4,767,419 | 8/1988 | Fattore . | |
| 4,800,600 | 1/1989 | Baum . | |
| 4,890,346 | 1/1990 | Rist . | |
| 5,048,892 | 9/1991 | Ledbetter | 5/663 X |
| 5,241,718 | 9/1993 | Pope . | |

*Primary Examiner*—Michael F. Trettel

*Attorney, Agent, or Firm*—Marshall, O'Toole, Gerstein, Murray & Borun

[57] ABSTRACT

Provided are protective pads which cover the balusters of a baby crib, comprising a cushioning material and means for affixing said pads to an inner surface of individual baluster.

4 Claims, 5 Drawing Sheets

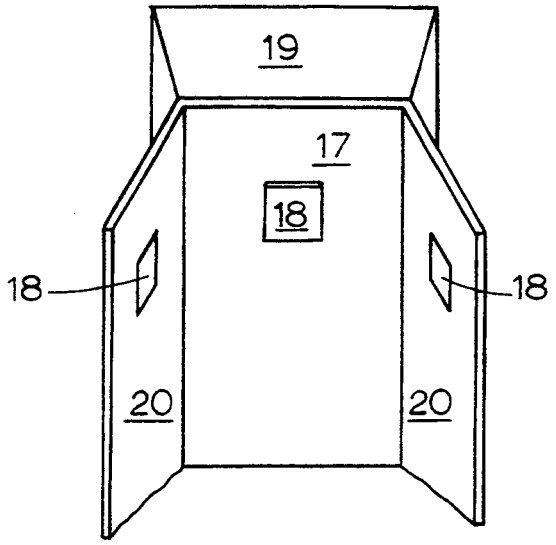
FIGURE 5
FIGURE 6
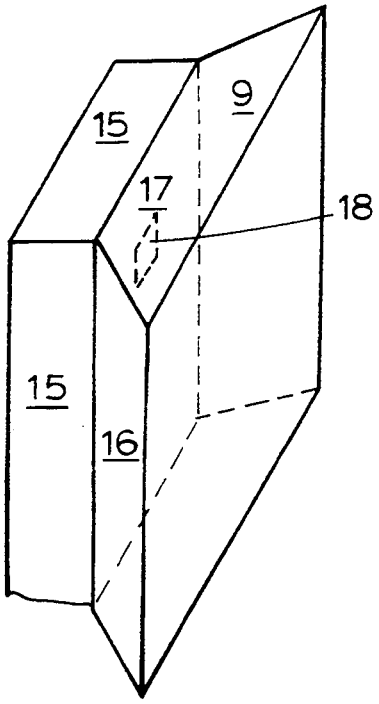
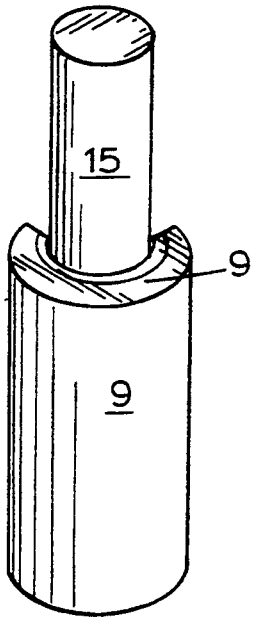
FIGURE 7A
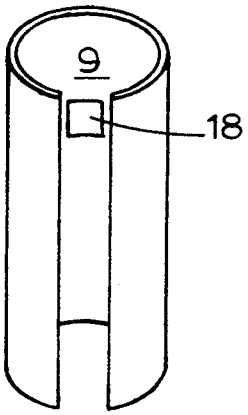
FIGURE 7B

INDIVIDUAL PROTECTIVE PADS FOR CRIB BALUSTERS

FIELD OF THE INVENTION

The present invention relates to protective pads for crib balusters which support crib railings and more particularly to any pad which individually and completely covers each of the balusters (vertical slats or uprights) of an infant or toddler crib or similar apparatus.

BACKGROUND OF THE INVENTION

Infants (less than 12 months old) and toddlers (between 12 and 36 months of age) are frequently confined to cribs or play pens for prolonged periods of time, not only while asleep but also when awake. Even at 30 months, many toddlers spend up to 16 hours in the crib during sleep alone. Thus, the crib constitutes an important primary environment for the very young. It is therefore essential to maintain the highest standards of safety in that environment. Consequently, of interest to the present invention are reports of safety bumpers (e.g., U.S. Pat. No. 959,116), including various fasteners (U.S. Pat. No. 3,877,090) and other connections of the bumpers to the crib mattress or bed sheet (U.S. Pat. Nos. 4,767,419; 4,890,346). The eagerness of consumers to protect their children has created a highly inflated market for crib bumpers, with bumpers now retailing for as much as $250.00 (e.g., NAVA bumpers). Indeed, the average bumper retails for approximately $70.00 (Baby Room, Inc., Chicago, Ill.). Presently, the crib bumper industry consists of over two dozen different companies in the United States alone which manufacture and distribute bumpers both locally and nationwide. Such bumpers, essentially identical in principle, vary primarily only in the thickness of the cotton batting filler, the cotton/poly blend of the outside of the bumper, and the color and design imprinted thereon; with some having ruffles or pockets which add nothing to the protection they provide and may make cleaning more difficult. However, bumpers and pads reported in the art inadequately protect against one of the greatest potential hazards found in the crib, the crib balusters. For purposes of the present application and by conventional definition, crib balusters refer to the vertical supports fixed between the horizontal railings.

The conventional home crib consists of legs, coasters, spacer tubes or springs, a metal frame for the mattress, a spring platform for the mattress, the mattress itself, vertical metal bars or guide assemblies, two end panels defining the minor axis of the bed [consisting of either a solid piece of wood, or a top and bottom horizontal rail with thin rectangular or cylindrical vertical slats (i.e., balusters) inserted between the railings] and two long sides defining the major axis of the bed. The two sides of the bed virtually always consist of one fixed side composed of two horizontal rails and numerous balusters inserted between the rails (each baluster is typically about 1 inch wide, and they are spaced approximately 2 to 2.5 inches apart) and an adjustable side which may be raised or lowered along two metal guide assemblies attached to the bed posts. Like the fixed or stationary side, the adjustable side is also composed of balusters and rails (the latter in contrast to the former are always horizontal by definition, and thus "horizontal rail" is a redundancy). The convention followed for the past five years by most (but not all) crib manufacturers is for the two end panels at the baby's head and feet to consist of balusters rather than solid pieces of wood to enable the baby to see the world beyond the crib on all four sides. Thus, most cribs have balusters along all four sides, extending from the mattress up to the side railings. These balusters comprise a greater surface area than any other single part of the bed, including the mattress. The balusters are made of wood virtually without exception, and without a bumper, the baby has absolutely no protection from injury resulting from the baby striking its head and/or body against the bars, either while lying near the bars and rolling into them during sleep or rest, or by falling down against them when standing or crawling, while awake. As described below, bumpers reported in the art fail to completely protect the infant from injury due to falling down against the balusters while standing; and also fail to protect the toddler from either rolling into the balusters during sleep or falling against them while standing, as bumpers are completely removed from the crib when the infant is only 6–9 months old.

A typical crib baluster may be cylindrical or rectangular, but, in any case, balusters are comprised of four sides: a side, wherein the surface area faces inward toward the crib (the innerside); a side, wherein the surface area faces outward (i.e. outside the crib) (the outer side); and two sides, wherein the surface area of each is at a right angle to the inward- and outward-facing sides.

The crib bumper has a number of distinct disadvantages and offers unsatisfactory protection for most of the time the baby is in the crib:

1) It is at best quite difficult or, with many bumpers, impossible to lower the adjustable side railing with the bumpers attached. Thus, each time the side must be lowered and raised, most parent or guardians untie and then retie the bumpers to all four posts of the crib. When this is not done and the side rails are raised and lowered without untying the bumpers, the ties invariably become loosened, and have to be resewn.
2) The bumpers tend to isolate the infant from the world outside the crib, as virtually all commercially available bumpers are opaque and completely cover all four sides of the crib to a height sufficient to block everything beyond the crib when the baby is in a supine position.
3) The bumpers are, for the most part, difficult to wash and maintain, and many tear easily. They may even remain permanently soiled, creating an ever-present unsightly and unsanitary condition. Moreover, they fail to dry well, and the use of high heat to dry them thoroughly invariably causes damage to the batting inside.
4) If the baby coats the bumper with emesis from projectile vomiting or feces from a loaded diaper (e.g., when the baby has diarrhea), the bumper must be removed from the crib for a considerable amount of time leaving the baby completely unprotected due to the need to wash and dry the bumpers.
5) To facilitate cleaning, bumper covers were previously plasticized. This has been discontinued for a number of reasons. In addition to being currently considered unaesthetic, the covers rip and/or tear easily with constant prolonged use. This was primarily due to the brittleness of the plastic which increased over time, especially with repeated machine washing and heat drying. Moreover, the seams affixing the plastic exterior to the remainder of the bumper may loosen or tear. With even small punctures or tears of the plastic and/or seams, the air-tight seal would be compromised, resulting in the growth of bacteria fungi on the cotton within the bumper, and in mildewing.

6) When the baby is able to raise itself up to the railing, it is prone to fall against the balusters. As bumpers of the art extend only approximately one third to one-half of the way up the balusters, the infant is far more likely to strike the upper two-thirds of the uprights as it falls downward from a standing position than it is to fall against the bumper.

7) The vast majority of bumpers are expensive and moderatelypriced bumpers (i.e., under $50–$70) and are either very difficult to find, or are of inferior quality and offer the infant little or no real protection.

8) If only a small section of the bumper becomes ripped or torn, badly soiled or otherwise damaged, the entire bumper requires replacement. As this occurs frequently, many consumers undergo the additional expense of having to purchase more than one bumper per child.

9) As the cotton or polyblend batting used in the bumper interior has only negligible impact absorbing properties, bumpers offer protection from injury solely by blunting the collision. Thus, their effectiveness is limited to only minor collisions involving little momentum. Previously, foam rubber was used as batting. However, the type of foam rubber used throughout the industry was too readily compressible, offering little resistance to hard falls directed against the bumper itself. Moreover, foam rubber batting could not tolerate repeated machine washing and drying, and has been largely abandoned as a result. Consequently, whether it contains cotton, polyblend or conventional foam rubber batting, the bumper cannot be relied upon to prevent injury in the event of hard falls against the bumper itself (e.g. as from a standing position).

10) A previous solution to offering increased protection from falls against the balusters consisted of making thick pads, about 1.5 to 2 inches or more in bulk. However, thick pads have been largely abandoned for a number of reasons; one being that thick pads are considered unaesthetic. More importantly, most children do not tolerate them. As the child grows in both stature and awareness, it becomes increasingly conscious of the fact that the bumpers are taking up more and more of the available space within the crib as he or she grows, and are preventing the child from looking out of the crib. Consequently, as it grows older, the child progressively and ever more rigorously attempts to remove thick bumpers from the crib. Alternatively, the child increasingly resists being in the crib with the bumpers present. Thin pads are better tolerated, but they offer commensurately less protection.

11) Possibly the bumper's greatest disadvantage is its complete failure to offer any protection to the toddler, irrespective of the cost or quality of the bumper. As the infant matures and spends progressively more time on its feet, it invariably attempts to climb over the side of the crib by standing on the bumpers, necessitating the complete removal of the bumpers from the crib. This typically occurs between the 6th and 9th months. Thus, from that age on, until the toddler leaves the crib at 30 to 36 months, i.e., for approximately 2 to 2½ years, there is absolutely no protection in the crib against impacts with the balusters either when the child is sleeping and turns suddenly toward and into the balusters, or when the child is awake and falls against the side of the crib, thereby striking the rigid, wooden balusters with its head or body and possibly sustaining a serious injury.

Thus, while many devices of the art offer protection against relatively minor hazards in the crib or play pen environment, there is none to protect the baby over 6 to 9 months against the most conspicuous crib hazard of all; the crib balusters. Moreover, bumpers reported in the art only provide protection against the bottom third of the crib balusters, are inconvenient to use, have a number of serious deficiencies and are expensive, primarily because there has been no alternative heretofore. Accordingly, there is a need in the art for protective coverings for crib balusters which overcome the disadvantages cited above.

SUMMARY OF THE INVENTION

The present invention provides protective pads for crib balusters which overcome disadvantages of using crib bumpers according to the art. Generally, the invention provides a flexible material which may be wrapped around a crib baluster. The material is shaped to conform to the height and width of the baluster or a portion thereof and comprises an enclosed internal cavity in which a cushioning material is housed. Finally, a connecting means for attaching the pad around a baluster is provided.

In a preferred embodiment, the connecting means comprises VELCRO TM (adhesive) strips placed on each of two opposite wide ends of the pad, such that when the pad is wrapped around a baluster, the VELCRO TM (adhesive) strips contact each other on the outer surface of the crib. Said strips may be of various sizes, ranging from small patches to extending the length of the pad. Also in a preferred embodiment, the connecting means may comprise a button and button hole assembly, whereby, the pad is buttoned together on the outer surface of the crib once the pad has been wrapped around the baluster. The connecting means may also comprise a zipper on the outer surface of the baluster (the outer surface being defined as the surface facing outside the crib when the pad is attached to the baluster). In a preferred embodiment of the invention, protective pads may be constructed such that they are connected to one, two, or three sides of the baluster. Connecting means for use in such an embodiment may be any suitable such means and may preferably be one or more adhesive pad(s) which may be directly connected to one, two, or three sides of the baluster. Also in a preferred embodiment, the pad may consist of a single closed surface, or of two or three closed surfaces joined together by a cover common to both, or of a closed surface having a cylindrical shape, the nature of which would be dependent upon the shape of the baluster, and which would cover only the surface of the baluster facing the crib and would be affixed to said surface by adhesive pads, etc. The skilled artisan recognizes that numerous connecting means may function to secure the pad to the baluster. Accordingly, numerous equivalents come within the scope of the present invention.

In a preferred embodiment of the invention, the flexible outer portion of the pad is comprised of any material which is non-toxic to an infant, and may most preferable be comprised of vinyl, rubber, cloth, or plastic. Also, the flexible outer material may be one, two, or three layers thick; and thickness may vary between the outer and inner portion of the pad on the surfaces of the pad.

Cushioning material for use in pads according to the invention may be any impact-absorbing material and may preferably be a cross-linked polyurethane compound. Additional useful materials for a cushioning material are foam rubber, cotton, gas, or liquid.

As an additional preferred embodiment of the invention, pads are provided which, instead of attaching to the baluster by virtue of compatible connecting means meeting on the outer side of the baluster, as described above, are attached directly to one, two, or three sides of the baluster by, for example, application of adhesive pads. In this embodiment pads are identical to the pads described above with the exception that they do not wrap around the entire baluster, but directly attach to either the inner side of the baluster, or to the inner side of the baluster and, in addition, one or two of the sides having its surface area at a right angle to the inner side of the baluster. FIG. 5 is a depiction of a protective pad according to the invention, wherein attachment of the pad to a baluster is on three sides of the baluster and wherein 19 represents the surface of the pad extending into the crib, 17 represents the surface of the pad contacting the baluster, 18 represents connecting means (adhesive pads); and 20 represents portions of the pad contacting adjacent sides of the baluster.

Protective pads according to the present invention may be of various sizes and shapes depending upon the length and thickness of the balusters to which the pads are applied. Generally, pads of the invention are approximately 0.6 inches greater in diameter than the diameter of a crib baluster. Moreover, protective pads according to the invention may be tapered to provide the greatest thickness of cushioning material in the center thereof. Preferably, pads according to the invention, may also be tapered at their lower end to enable one to lower the crib railing without removing the pads. Finally, pads may be adapted for use with cylindrical balusters as shown in FIGS. 7(*a*) and 7(*b*). FIG. 7(*a*) represents a pad attached to a cylindrical baluster, wherein 15 is the baluster, and 9 is the pad. FIG. 7(*b*) is a view of the inner surface of the pad depicted in FIG. 7(*a*); wherein 18 represents a connecting means. A pad may be affixed to a baluster such that the pad subtends any angle from about 0 to about 180 degrees.

Numerous alternative embodiments of the invention are apparent. For example, pads may contain a separate outer removable covering which may contain designs or may be colored or may be clear. Pads may also be equipped with vertical slots either in the flexible material or in the separate outer removable covering into which strips of various color or design may be inserted (design strips).

Additionally, protective pads according to the invention may cover more than one baluster. Pads may also be made to be fire-resistant or fire-retardant.

Various embodiments of the invention and advantages over the prior art are provided in the following Detailed Description of the Invention.

DESCRIPTION OF THE DRAWINGS

FIG. 5 is a view of a pad attached directly to a baluster on three sides.

FIG. 6 is a view of a pad attached to only the inner surface of a baluster.

FIG. 7(*a*) and 7(*b*) are views of a pad for attachment to a cylindrical baluster.

DETAILED DESCRIPTION OF THE INVENTION

Figure 1:
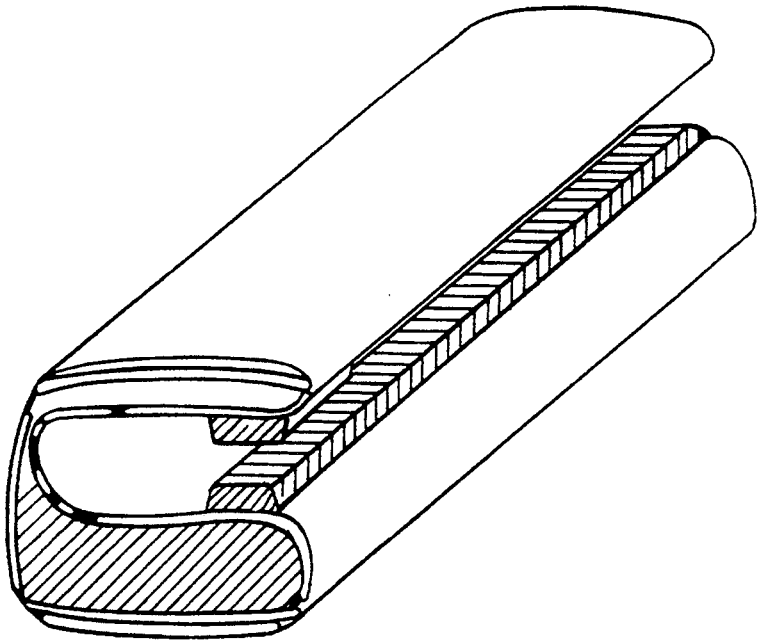
FIG. 1 is a cross-sectional view through a baluster pad.
Figure 2:
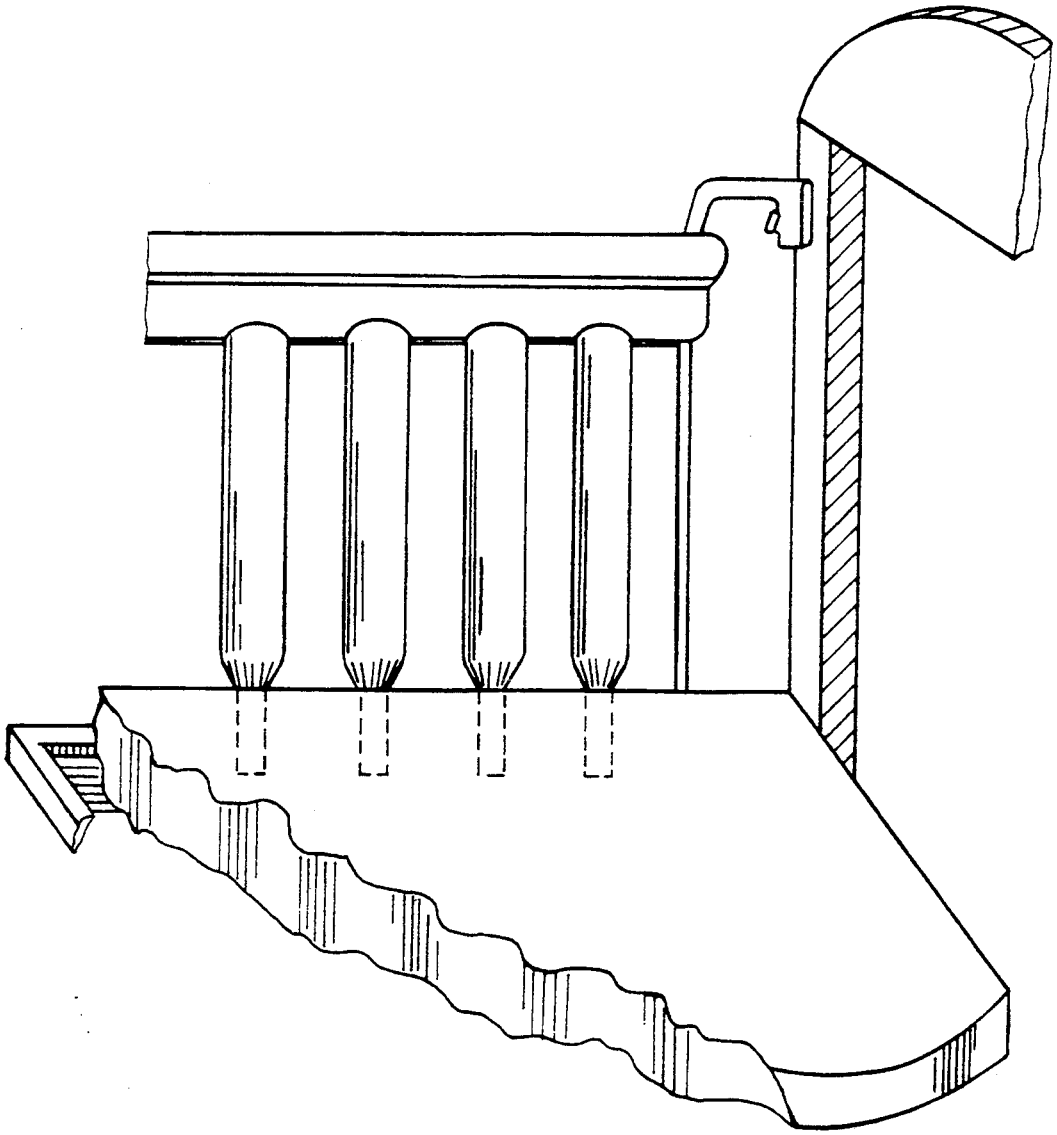
FIG. 2 is a view of pads attached to crib balusters.
Figure 3:
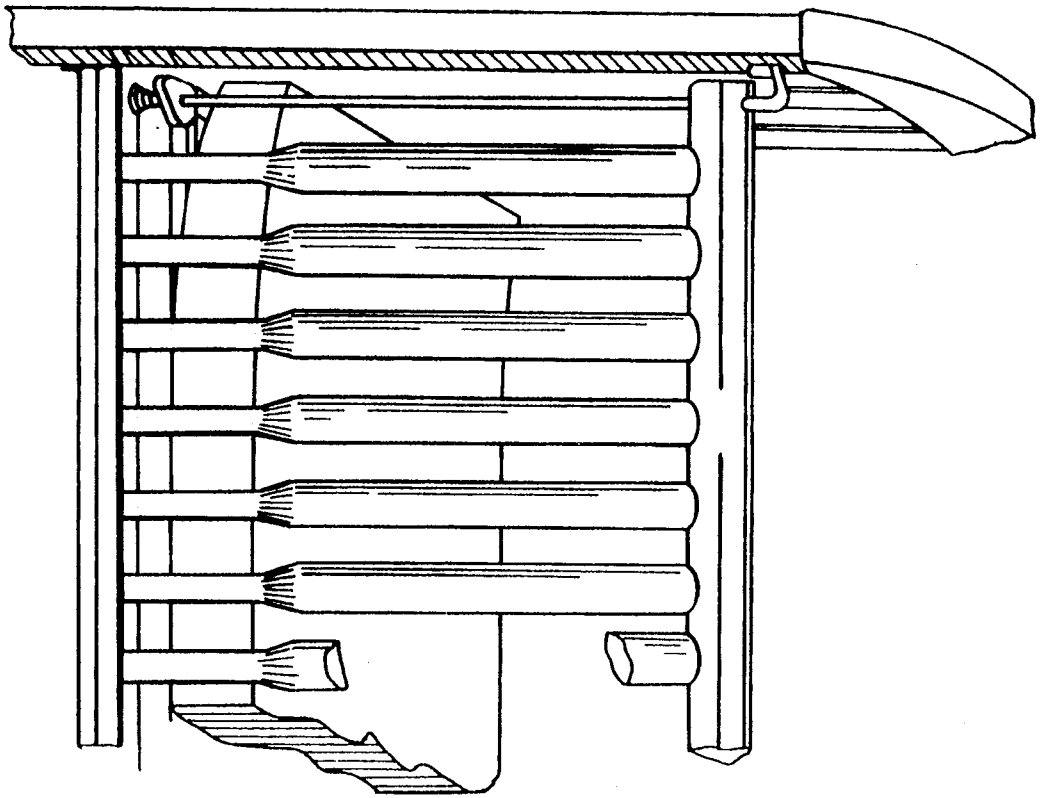
FIG. 3 is a view from outside the crib of pads attached to crib balusters.
Figure 4:
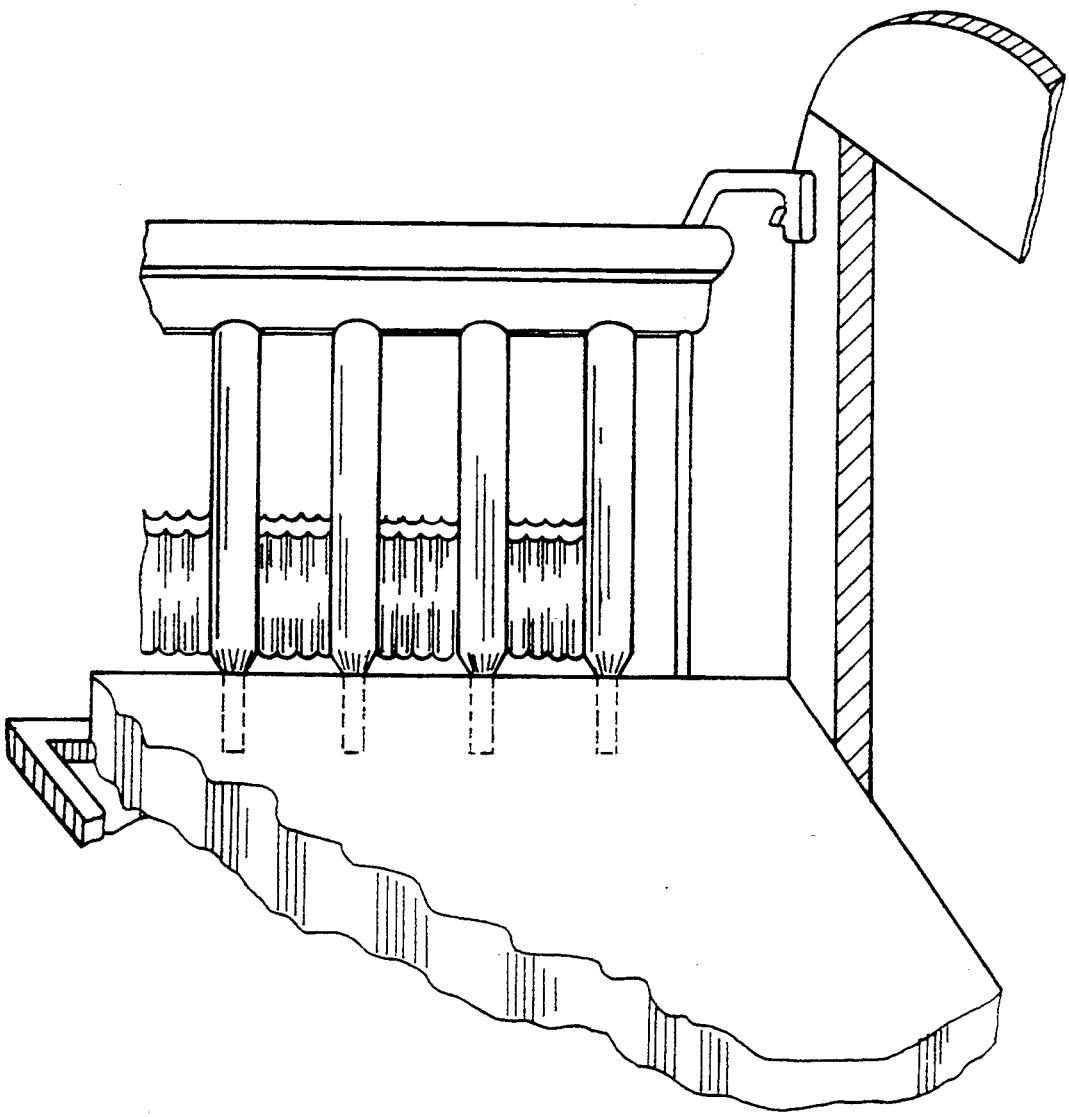
FIG. 4 is a view of pads and flaps attached to a crib baluster.

The present invention surmounts all of the disadvantages of the prior art described above, in a highly cost-efficient manner. In a highly preferred embodiment pads according to the present invention are rectangularly shaped and covered or lined not solely but with a bilayer of vinyl on the surface and an inner immediately adjacent layer of thermoplastic polyamide (specifically nylon; i.e. 14 gauge Imperial-200 fabric) which is highly durable, puncture resistant tear-proof and water-proof inside and out. The pad covering is aesthetically designed with a matte finish and a soft appearance in marked contrast to the shiny, rigid look of plasticized bumper covers, and prior to sealing, the inside of the cover which is waterproof, is coated with a mild non-toxic anti-fungal and anti-bacterial detergent. The side of the pad facing the interior of the crib may be slightly curved (i.e., convex; subtending an angle of 5°–15°) thereby eliminating any sharp pad edges that could scratch the baby. The length of the pad is identical to the length of the crib balusters down to but not below the crib mattress (viz. 18″–20″) and its width on each side is about 0.6 inches greater than the approximately 1.0 inch width of the balusters. The entire external surface of the pad may also be coated with a non-toxic flame-retardant (a feature absent from virtually all bumpers.) On the side facing the interior of the crib, a resilient, 1 to 2 inch impact-absorbing material (hereinafter batting) such as foam rubber or a similar spongy material is enclosed, situated between the third layer of the pad and the side of the baluster as shown in FIG. 1. The batting is comprised of polyurethane, and more specifically, the polyester-polyurethane copolymer (1.5–2.0 lb/cu. ft. density; e.g. 4750 foam with a 25% compression force deflection of 0.6 p.s.i) which has an ideal combination of durability, clickability (ability to completely re-expand when the compression force is removed), density, impact resistance and compressibility. In this regard the polyester-polyurethane co-polymer is preferable to polyether-polyurethane copolymer which is too soft and compressible and thereby offering insufficient impact resistance; and for the same reasons is far superior to the light spongy rubber heretofore used in crib bumpers and also used in pillows, seat cushions and mattresses and prepared inter alia, by bubbling $CO_2$ through or driving air into latex (viz. sponge rubber, latex foam, or foam rubber). For similar reasons, the polyester type of polyurethane is superior to natural or synthetic sponges such as those used for cleaning and absorbing water and other liquids. Regarding the pad in its vertical aspect, the layer of batting is gradually attenuated in thickness beginning about 2 inches above the mattress downward, and thus the bottom approximately 2 inches of the pad are tapered as seen in FIG. 2, enabling the adjustable side railing to be lowered below the mattress. The impact absorbent polyurethane material used in the batting is sufficiently compressible to enable the railing to be easily lowered and raised against with no displacement of the pad. A slit running down the entire length of the pad appears at the end opposite to that containing the impact absorbing material, and an approximately 0.4 inch VELCRO TM (adhesive) pad is featured on either side of the slit (FIG. 1). Each pad engages a single baluster through the slit provided, and is held in place against the baluster by a firm pressing together of the VELCRO TM (adhesive) strips on either side of the slit. Horizontal slits at the top of pads with transparent vinyl covers enable the insertion of flexible plastic or paper strips imprinted with various designs and colors which may be color-and-design coordinated with the crib quilt. These are either inserted only in front of the batting (i.e., facing the interior of the crib) with the transparent opposite side of the pad facing away from the crib revealing the color and texture of the wooden balusters; or are inserted on both sides of the pad, enabling the same design to appear on both the inside and outside of the crib.

Also in a preferred embodiment, pads according to the present invention may be attached to only the inner surface of a baluster and may be of equivalent width to the baluster at the point of attachment but because wider as one progresses to their outmost extent. (See FIG. 6). FIG. 6 is a depiction of a pad attached to only one side of a baluster, wherein 15 represents the baluster, 9 represents the pad, which may be equal to or greater or less than the width of the balusters, 16 represents the sides of the pad, 17 represents the portion of the pad contacting the baluster, and 18 represents a connecting means. Preferably, the pad is greater in width as it extends away from the baluster to prevent contact with the sides of the baluster at right angles to the inner and outer sides of the baluster.

Instead of a plastic, the pad exterior (i.e., pad cover or lining) may comprise cloth (preferably composed of synthetic fibers which are easy to clean, dry and maintain), or rubber, with or without additional (spongy) impact-absorbing batting placed within. Moreover, as an alternative to the use of polyurethane or specifically, polyether polyurethane co-polymer, another spongy material such as foam rubber may be used as batting, or the pad may contain a tear and leak-proof plastic envelope filled with air, or less desirably, may contain cotton or polyblend batting. Each pad may extend horizontally well beyond 0.6 inches to 0.625 inches past the horizontal edge of the baluster to cover any portion of the space between the balusters, or each pad may cover a number of balusters (e.g., as many as three or more). Furthermore, the pad may extend vertically only part-way up the baluster, and the vinyl of the plastic over or lining of the pad may contain only 1–2 layers or more than 3 layers, or a scrim of nylon, rayon, or another synthetic fiber. Finally, in place of VELCRO TM (adhesive) strips, snaps, clips, or buttons may be used.

Protective pads according to the present invention have numerous advantages over the prior art as outlined below.

1) An important advantage of the present invention over the prior art is its ability to provide constant and maximal protection for the infant and toddler whenever the child is in the crib. Falls against any part of the balusters from a kneeling or standing position will always be cushioned by the pads in marked contrast to bumpers. Moreover, the toddler as well is fully protected by the pads during both sleep and waking, at an age when bumpers are usually completely removed from the crib.
2) The pads provide a distinct developmental advantage to the infant's visual awareness as the infant or toddler may easily look through the balusters. This is possible as the pads covering the balusters are about 0.6 inches wider than the balusters themselves, leaving an empty space of approximately 1.5 to 2 inches between the covered sides of the balusters, depending upon the inter-baluster spacing of the particular crib being used. This not only promotes visual stimulation and awareness, but also enables the parents or guardians to monitor the infant or toddler through the bars of the crib without having to walk directly up to the crib and possibly awaken the baby.
3) The pads are unobtrusive, tightly hugging the balusters, enable the child to readily see through the space between the balusters, and are perceived by the child as an integral part of the balusters themselves, rather than as a bulky and intrusive separate entity. Consequently, they are far better tolerated than bumpers by the child who is commensurately less prone to try to remove them. All of these features are reinforced by the virtual impossibility of their being removed or even loosened by the child.
4) While bumpers are difficult to clean and dry as mentioned above, may be damaged by thorough drying with heat, and may even remain permanently soiled, creating an everpresent unsightly and unsanitary condition, the plastic covering of pads according to the invention may be easily cleaned by merely running a damp cloth up and down its sides, and the vinyl pad covers dry quickly merely by exposure to air. Consequently, if the pads become soiled while the baby is in the crib, they may be quickly cleaned while still attached to the balusters, providing the baby with continuous protection. This is in marked contrast to the soiled bumper, which would have to be removed from the crib for a prolonged period for washing and drying in machines.
5) Pads according to the present invention are preferably so constructed that they may be placed on when the infant first enters the crib, and may remain there without having to be removed until the toddler permanently leaves the crib and moves on to sleeping in a bed. Thus, unlike bumpers, the pads rarely if ever have to be removed let alone entirely replaced a number of times.
6) In the event that a small section of a bumper becomes torn, ripped, badly soiled or otherwise damaged, the entire bumper must be replaced. However, the pads provided by the present invention can be individually replaced if sold in replacement packages of 2 or 3 for only a few dollars. Consequently, a full set of pads need only be purchased once for as long as the child needs the crib.
7) The pads hug the balusters and may be tapered at the bottom, enabling them to be lowered and raised without removing them. This constitutes a considerable advantage over bumpers which must be removed each time the railing is lowered or raised.

8) The pads are simple and inexpensive to manufacture, with mass production costs for materials being about $8.00 for a set of 40 bumpers. Moreover, the simplicity of the design assures low set-up costs for production.

9) The pads also provide a non-toxic fire retardant over their entire external surface, a feature missing from virtually all bumpers (this feature is optional).

In addition to being available in many different colors, the pad cover facing away from the crib, may be made of a multilayer clear vinyl enabling the color and texture of the wood of the baluster to show through. See FIG. 1. Alternatively with its matte finish and soft cloth like appearance, the cover of the pad may be imprinted with colors coordinated with those of the crib quilt, or as another option, magic markers or acrylic paint of different colors may be made available to the consumer as accessories enabling the consumer to decorate the bumpers to taste. Various designs may be printed on these paper strips to color and design coordinate with the crib quilt, which would show through the clear vinyl on the outside of the pads, and these strips may also be provided as accessories. Alternatively, (1) the bumpers may be made of 100% nylon (500 denier Cordura) which is a soft, flexible matte finished, puncture and tear resistant cloth or (2) a soft textured plastic with a matte finish or cloth made of synthetic fiber which is easily washed and dried, and color and design coordinated with the crib quilt; or (3) paper or cloth strips with adhesive backs may be available as accessories in a variety of colors and designs which the consumer can later purchase and apply to the external surface of the pad. As the batting of the pad consists of polyurethane or a similar spongy material rather than the batting of cotton or cotton-polyester blend found in bumpers, all of these covers may be used, and easily cleaned and dried, with no damage resulting to the pad covering or batting pad.

The pad can be made to closely resemble a conventional bumper. Thus, a multi-layer tab, flap or ruffle may extend from the inner (narrow) sides of each pad and overlap with the flap or ruffle of the pad immediately adjacent, giving the appearance of a continuous bumper around all four sides of the crib. The pad may extend from only the middle of each baluster to the mattress, and the outer cover of the pad may be made of a synthetic fiber or polyblend cloth. Thus, the pad could assume nearly the same form as the bumper in the material comprising its cover, and in its patter, color, height, continuity and general appearance, and still retain practically all of its functional advantages:

1) As the baby or toddler could not gain any footing by stepping on the flaps or ruffles between the crib balusters, the pad could remain permanently attached to the crib until the child leaves it for a bed.

2) Since the bottom of the tab is tapered and the flaps are attached to the pads, the flexible crib railing could still be lowered and raised without the need to remove the pads or flaps.

3) The tight fit of each pad against the baluster provided by the VELCRO TM (adhesive) strips and the vertical support of each pad combined with the synthetic or polyblend composition of the cloth covering would ensure easy cleaning and maintenance.

4) The pass-through-slit and VELCRO TM (adhesive) strip engagement of pad to baluster would continue to provide an ease and efficiency in putting the pads on the balusters and removing them.

5) The multi-layer design of the synthetic or polyblend cover would ensure a resistance against tearing or ripping of the pad.

6) In the event of a pad being damaged, only the single damaged unit need be replaced, rather than the entire assembly, as in the instance of bumpers.

7) Most importantly, the impact-absorbing properties of the pad would provide significantly greater protection from injury than that afforded by the bumper.

For some consumers, form is at least as important as function, and for others, it is even more important. The latter are therefore willing to sacrifice function for form to some extent. Fortunately, there is only one primary function of the preferred embodiment that need be sacrificed; viz. the pad described above would not protect the child from falls against the upper half of the balusters, and there is no way to mitigate this. However, the other primary functional advantages of the preferred embodiment remain intact, as seen above. While it would appear that a continuous pad and flap covering the bottom half of the crib would render it impossible, for the child to see out of the crib, and would not permit the parents or guardian to look inside the crib from outside, this can be enabled by affixing the overlapping flaps or ruffles to the inner sides of the pads by means of narrow VELCRO TM (adhesive) strips. The flaps or ruffles could then be added or removed from the pads for washing, aesthetic appearance or to enable the child to see out of the crib as the consumer desires.

I claim:

1. A protective pad for a crib baluster, comprising:

a flexible material sufficient in length to extend from approximately the top of said crib baluster to approximately the bottom of said crib baluster and having an internal surface and an external surface, said internal surface defining an entirely enclosed internal cavity;

a cushioning material contained within said internal cavity, such that the entirety of said flexible material and said cushioning material may be wrapped around said crib baluster; and means for affixing said protective pad to an inner surface of said crib baluster, such that said pad subtends an angle from about 0 degrees to about 180 degrees.

2. A protective pad for a crib baluster, comprising:

a flexible material sufficient in length to extend from approximately the top of said crib baluster to approximately the bottom of said crib baluster and having an internal surface and an external surface, said internal surface defining an entirely enclosed internal cavity;

a cushioning material contained within said internal cavity, such that the entirety of said flexible material and said cushioning material may be wrapped around said crib baluster; and connecting means for securing said protective pad to one, two, or three sides of said crib baluster.

3. The protective pad according to claim 2, wherein said connecting means secures said pad to three sides of said baluster.

4. The protective pad according to claim 2, wherein said pad is attached only to the inner portion of a baluster and wherein said pad is identical in width to said baluster at a point of attachment to said baluster and is progressively wider at points further removed from said part of attachment.

* * * * *